US007341091B2

(12) United States Patent
Nien et al.

(10) Patent No.: US 7,341,091 B2
(45) Date of Patent: Mar. 11, 2008

(54) CONTROL DEVICE FOR VENETIAN BLINDS AND ITS CONTROL METHOD

(75) Inventors: Ming Nien, Taichung (TW); Yuche Wen, Gueishan Township, Taoyuan County (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 432 days.

(21) Appl. No.: 11/006,671

(22) Filed: Dec. 8, 2004

(65) Prior Publication Data

US 2005/0161168 A1 Jul. 28, 2005

(30) Foreign Application Priority Data

Dec. 9, 2003 (TW) ..... 92134754 A

(51) Int. Cl.
*E06B 9/30* (2006.01)

(52) U.S. Cl. ..... 160/170; 160/173 R

(58) Field of Classification Search ..... 160/84.05, 160/121.1, 319, 320, 168.1 R, 178.1 R, 173 R, 160/170
See application file for complete search history.

(56) References Cited

U.S. PATENT DOCUMENTS 5,628,356 A * 5/1997 Marocco ..... 160/170
5,890,529 A * 4/1999 Haarer ..... 160/319
6,129,131 A * 10/2000 Colson ..... 160/84.02
7,128,126 B2 * 10/2006 Smith et al. ..... 160/319
7,159,635 B2 * 1/2007 Holt et al. ..... 160/84.05

* cited by examiner

*Primary Examiner*—Blair M. Johnson
(74) *Attorney, Agent, or Firm*—Ming Chow; Sinorica, LLC

(57) ABSTRACT

A control device for Venetian blinds and a control method includes a position unit, a rope-control unit and a movement limit unit. The position unit is fixed in an upper rail. The rope-control unit consists of a wind wheel, a rope, an engage wheel and a clutch. The wind wheel is pivotally connected to the position unit, and the rope has one end fixed with the wind wheel and the other end hanging down for a user to handle. The rope rotates the wind wheel, and the engage wheel fits with the wind wheel and fixed with the hanging unit. The clutch is connected with and can be rotated by the wind wheel in a first direction, or the wind wheel and the engage wheel does not rotate together in case of rotation in a second direction. The movement limit unit has a lever member swung by the rope to engage with or disengage from the ratchet for the hiding unit to rise up or move down and be positioned stably.

22 Claims, 12 Drawing Sheets

CONTROL DEVICE FOR VENETIAN BLINDS AND ITS CONTROL METHOD

BACKGROUND OF THE INVENTION

1. Field of the Invention

This invention relates to a control device for Venetian blinds and its control method, particularly to one having safety with a rope not exposed and handling convenience of a rope exposed.

2. Description of the Prior Art

Conventional control device for Venetian blinds are generally classified into two kinds, one with a rope exposed and the other with a rope not exposed.

The rope-exposed control device for Venetian blinds includes an upper rail, a lower rail, a window covering positioned between the upper rail and the lower rail, such as cloth member of a winding blind, a plurality of strips of a Venetian blind, and a moving up-and-down device for combining the window covering between the upper and the lower rail. The moving up-and-down device generally is composed of a ratchet fixed on the upper rail, and plural strips of the window covering placed between the upper and the lower rail and a pull rope arranged between the ratchet and the window covering. The rope has a portion extending out of the ratchet and is exposed for a user to pull or loosen for controlling a position of the window covering moved together with the lower rail. But this kind of the partially exposed rope is a no-end loop-shaped one, which may cause potential danger of hurt or suffocation with the neck of a child caught by the rope in pulling it as a play.

As for the non-exposed one, it includes an upper rail, a lower rail, a window covering positioned between the upper and the lower rail, and a moving up-and-down device combining the window covering between the upper and the lower rail. The moving up-and-down device has plural springs fixed on the upper rail, and a position rope pulling the window covering between the upper and the lower rail. Then the position of the window covering is controlled by the control device to be altered as needed. Maybe other moving up-and-down devices can be used such as utilizing the tension of the position rope. Generally speaking, the non-exposed rope device is not so convenient as the exposed rope control device in handling. Moreover, there is also a disadvantage that the spring may lose its resiliency after a period of use, or the position rope may lose its tension sooner or later.

SUMMARY OF THE INVENTION

The main purpose of the invention is to offer a control device for Venetian blinds and its control method, having both safety of the no-exposed rope one and convenience of the exposed rope one.

Another purpose of the invention is to offer a control device for Venetian blinds and its control method, hiding the exposed rope to be held by a user, for reducing potential danger of neck constricting by the rope tampered by a child.

The feature of the invention is a position unit, a rope control unit, and a movement limit unit. The position unit is fixed in an upper rail of a Venetian blind, and the rope-controlling unit is composed of a wind wheel, a rope, an engage wheel and a clutch. The wind wheel is pivotally connected with the position unit, and the rope has one end fixed with the wind wheel and the other end hanging down for a user to handle, so the rope may rotate the wind wheel. The engage wheel fits with the wind wheel and also fixed with the window covering, and the clutch is connected with the wind wheel and the engage wheel. When the rope with the clutch rotates in the first direction, the wind wheel and the engage wheel rotate in the same direction, or rotates in a different direction in case of said rope and clutch rotating in the second direction. The movement limit unit is pivotally connected with the position unit, having an engage member to be rotated by the rope and engage or disengage from the ratchet for controlling the window covering in rising up and moving down and secured stably at a position.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
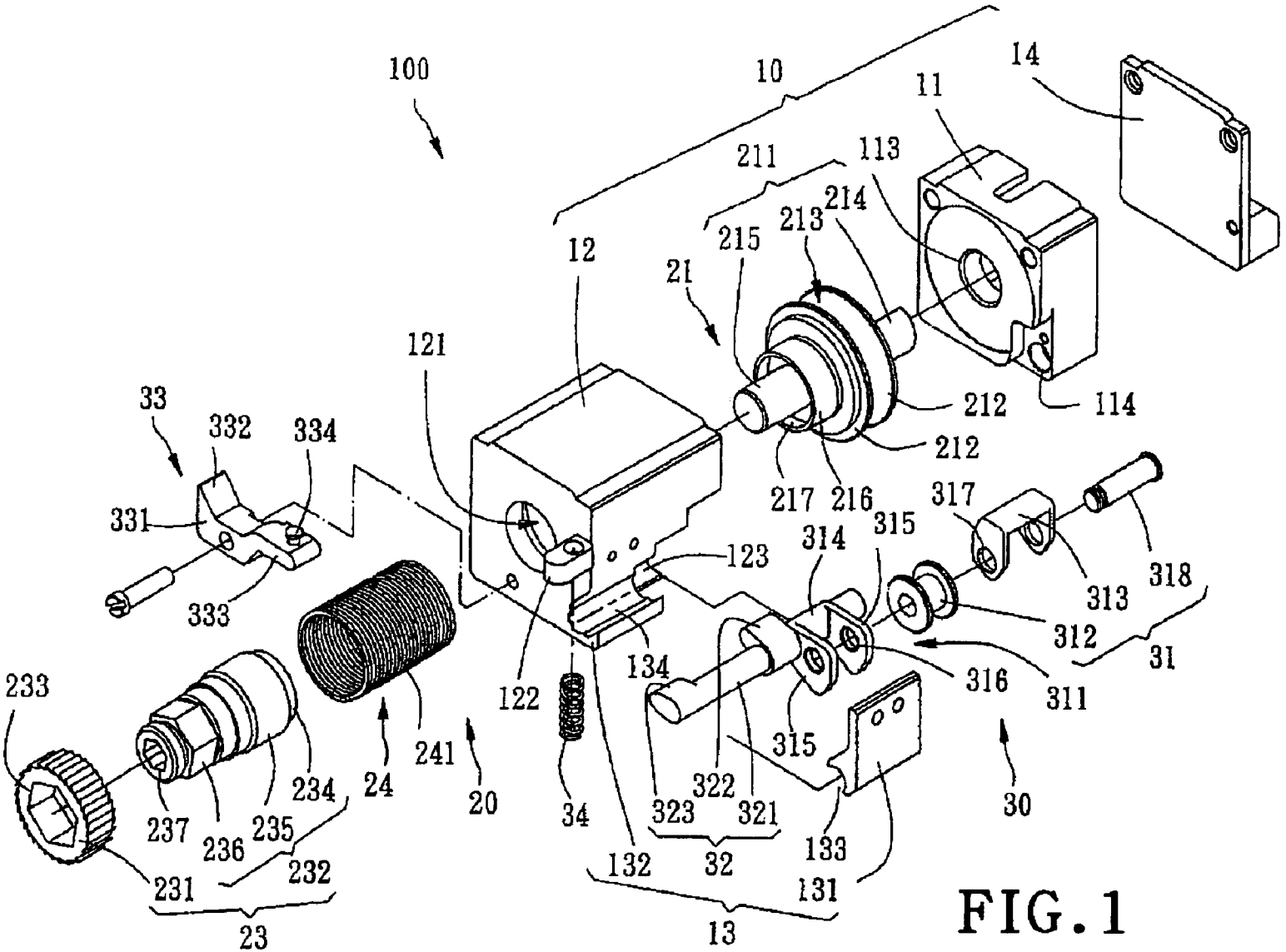
FIG. 1 is an exploded perspective view of a first embodiment of a control device for Venetian blinds in the present invention.

A first embodiment of a control device for Venetian blinds in the present invention, as shown in FIGS. 1, 2, 3 and 4, includes a position unit 10, a rope control unit 20, a movement limit unit 30, and a return unit 40 as main components.

The position unit 10 consists of a base 11, a main cover 12, a retainer 13 and a seal cap 14.

The base 11 is shaped rectangular, having a chamber 111 of a preset width and depth formed in a rear portion, an opening 112 of the chamber 111 formed in the rear side, a center hole 113 in the front wall and communicating with the chamber 111, a pivot hole 114 formed in a corner of the front wall. The center hole 113 has a diameter smaller than the inner diameter of the chamber 111.

The main cover 12 has its opening facing downward, and a chamber 121 of a preset dimensions formed in its interior, a hole respectively in a front and a rear side and communicating with the exterior, a projection 122 on a front side beside the hole, a contacting member 123 extending out from the rear side and having a recessed groove.

The retainer 13 consists of a first retainer 131 and a second retainer 132, and the first retainer 131 has a first groove 133 formed semi-circular on a lower end of an inner side, and the second retainer 132 extends from the same side of the contacting member 123 of the main cover 12, having a second groove 134 (like a concave) on its upper surface.

The seal cap 14 is located behind the chamber 111 of the base 11 and closes up the opening 112.

The rope control unit 20 consists of a wind wheel 21, a rope 22, an engage wheel 23 and a clutch 24.

The wind wheel 21 is composed of a round rod 211, two flanges 212 spaced apart in parallel, and a fitting stage 216.

The two flanges 212 are located on the intermediate portion of the round rod 211 separated by a preset gap, which makes up a rope winding stage 213 between the two flanges 212 on the round rod 211, and a position stage 214 behind the two flanges 212 and a connect stage 215 in front of the two flanges 212. The position stage 214 has a diameter a little less than the diameter of the hole 113 of the positioning unit 10, extending in the hole 113. Further, an annular fitting stage 216 is provided around the connect stage 215, extending forward from the front flange 212, having an outer diameter larger than that of the connect stage 215, defining an annular connect groove 217 with the connect stage 215 therebetween.

The rope 22 has one end tied with the rope winding stage 213, and the other end tied with a hanging block (not shown), with the weight of the rope and the hanging block makes the rope 22 hanging down from the winding stage 213.

The engage wheel 23 has a ratchet 231 and a connecter 232, and the ratchet 231 has many inclined teeth around the spherical edge and a hexagonal fitting hole 233 in the center. The connecter 232 is shaped as a post, having a connect stage 234 with a diameter the same as the connect groove 217 of the wind wheel 21, an actuating stage 235 with a diameter the same as the outer diameter of the fitting stage 216, a fitting stage 236 with a hexagonal cross-section, and a transmitting groove 237 of a non-circle in a front end, (in this embodiment the transmitting groove is hexagonal). The one-way ratchet 231 is tightly combined with the fitting stage 236 of the connecter 232 because of the special shape of the fitting hole 233.

Figure 12:
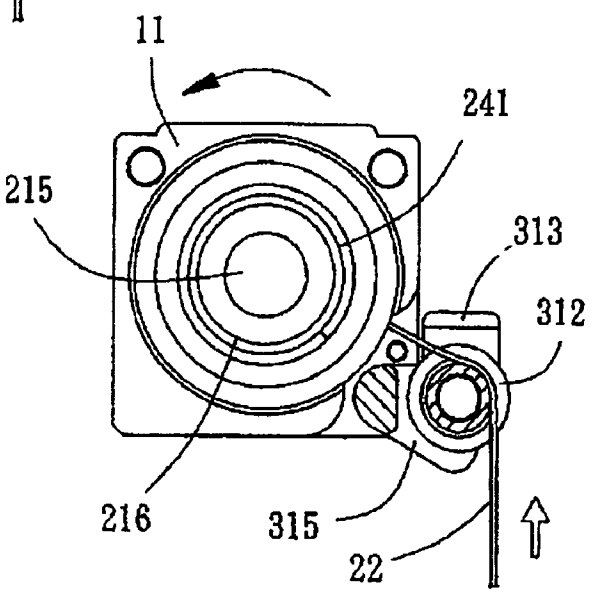
FIG. 12 is a cross-sectional view of the first embodiment of a control device for Venetian blinds in the present invention, showing the one-way constrict spring not receiving exterior force.
Figure 13:
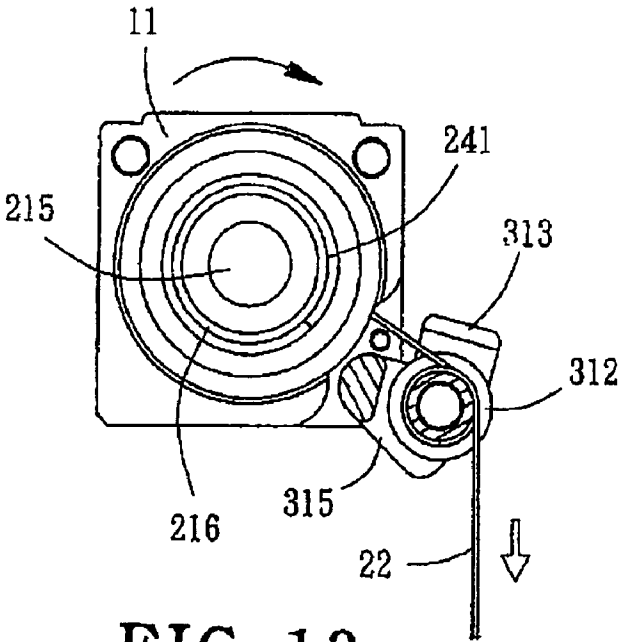
FIG. 13 is a cross-sectional view of the first embodiment of a control device for Venetian blinds in the present invention, showing the one-way constrict spring receiving exterior force.
Figure 14:
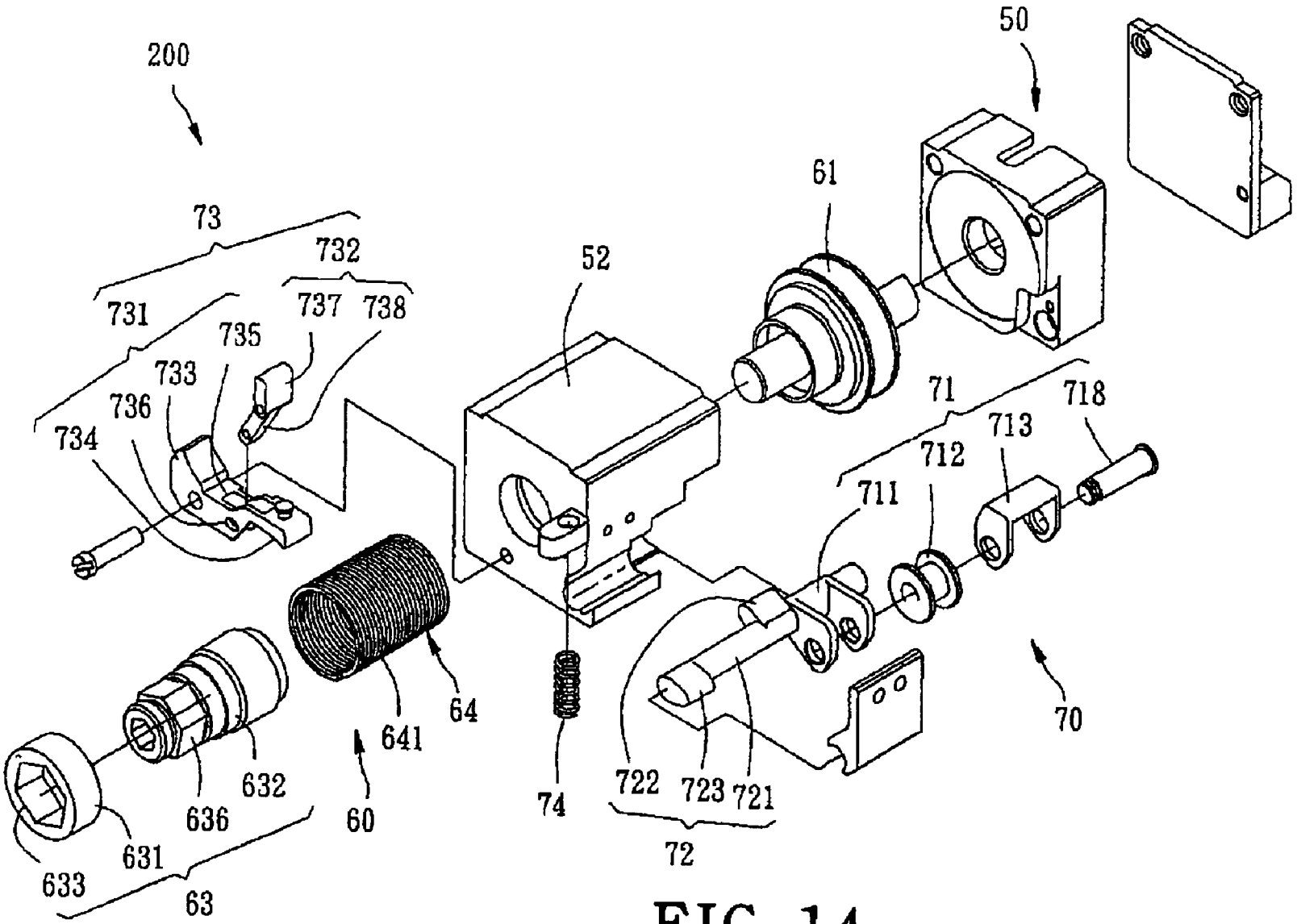
FIG. 14 is an exploded perspective view of a second embodiment of a control device for Venetian blinds in the present invention.
Figure 15:
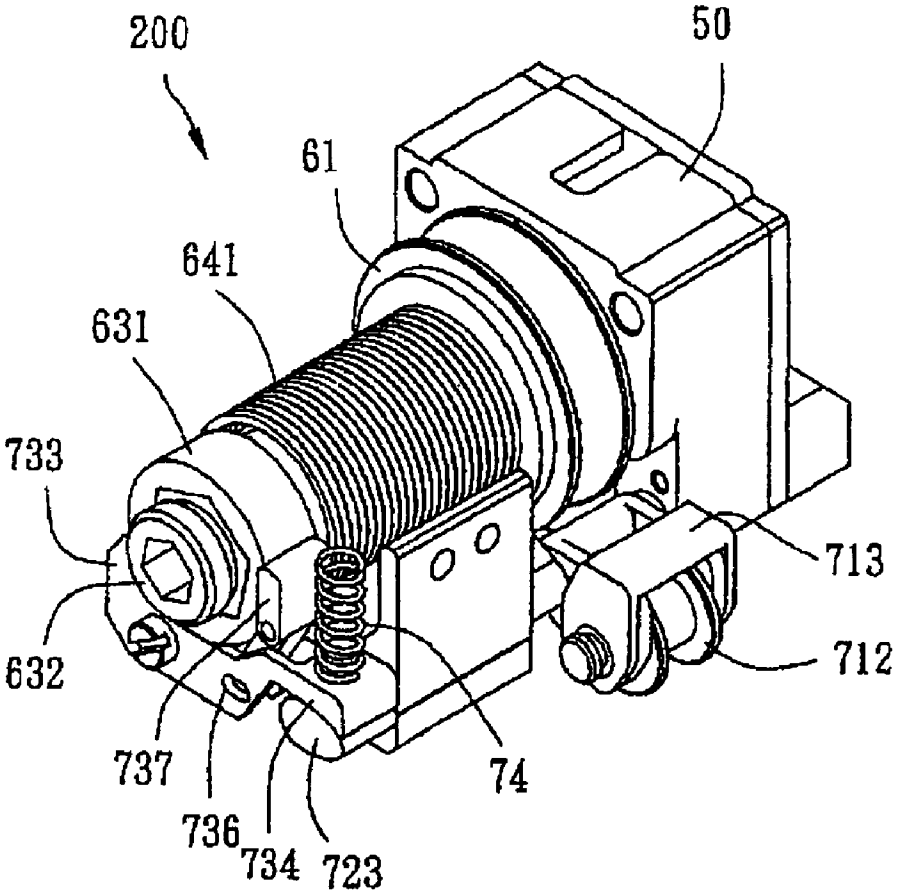
FIG. 15 is a partial perspective view of a Venetian blind with the second embodiment of a control device in the present invention, showing a main cover removed.

The clutch 24 is a one-way constrict spring 241 provided with one-way winding direction (as shown in FIG. 13, constricting its inner diameter in case of clockwise rotation), constricting in the clockwise rotation and loosening in case of counterclockwise rotation, as shown in FIG. 12. The one-way constrict spring 241 has an outer diameter the same as that of the actuating stage 235 of the connecter 232 of the engage wheel 23 when not receiving exterior force.

The movement limit unit 30 produces its function by exterior force, by engaging with or disengaging from the engage wheel 23, consisting of an input member 31, a connective rod 32, a movement limit member 33, and a coil spring 34 with a preset force.

The input member 31 is composed of a bias swing member 311, a force-receiving member 312, and a position member 313.

The bias swing member 311 has a tubular member 314 and two parallel wings 315 extending in the same direction from the tubular member 314 and having a pivot hole 316 respectively and the two holes 316 aligned to each other.

The force-receiving member 312 is a wind wheel with a center through hole, located in the gap between the two parallel wings 315 of the bias swing member 311.

The position member 313 is U-shaped, having a hole 317 respectively in each of two free ends, and the two holes 317 are aligned to the pivot holes 316 of the two wings 315. A pin 318 is fitted through the holes 317, the pivot holes 316 and the center through hole of the force receiving member 312 so that the force receiving member 312 may be located between the two wings 315 and rotate with the pin 318 as a pivot.

The connective rod 32 is divided into a round rod member 321, a position limit member 322 and an actuating member 323. The position limit member 322 is located in the intermediate portion of the round rod member 321 and protruding sidewise, and the actuating member 323 is located at the front end of the round rod member 321 and protruding sidewise in the same direction as that of the position limit member 322. The round rod 321 has its free end inserted in the tubular member 314 of the input member 31, extending out for a preset length, letting the tubular member 314 tightly combined and moves together with the round rod 321.

The movement limit member 33 is provided with a lever member 331, which has one end formed with an upward claw 332, and the other end formed with a resist member 333 and a position projection 334 on the resist member 333. Then the coil spring 34 with a preset force has its lower end resting on the position projection 334.

Figure 5:
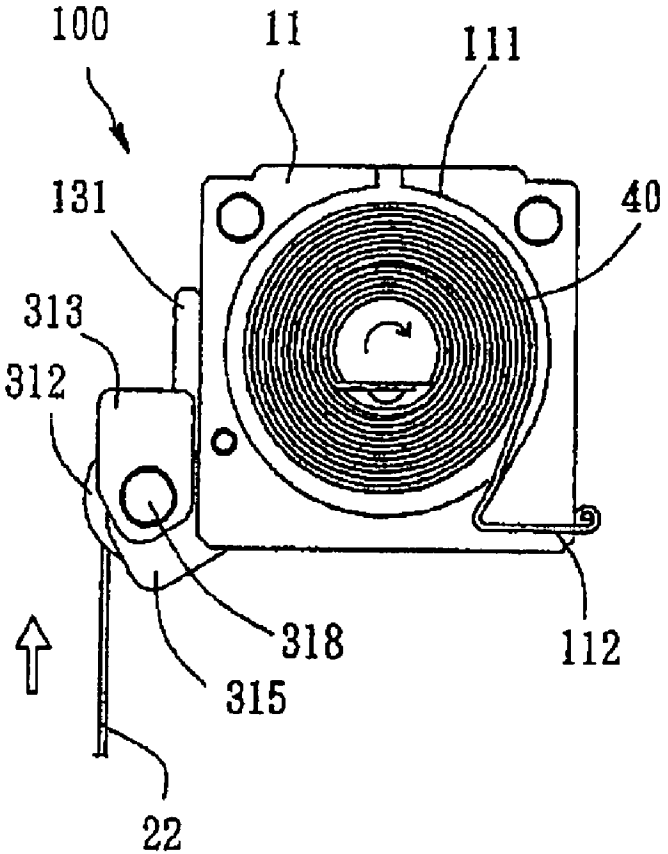
FIG. 5 is a cross-sectional view of the first embodiment of a control device for Venetian blinds in the present invention, showing a return unit not receiving exterior force.

The return unit 40, as shown in FIG. 5, is a helical spring, contained in the chamber 111 of the base 11 of the position unit 10, having its one end fixed tightly on the position stage 214 of the rope control unit 20, and the other end extending out of the opening 112 of he chamber 111 and impossible to retreat in the chamber 111 restricted by the annular edge of the opening 112.

Next, In assembling the control device for Venetian blinds, firstly, the one-way constrict spring 241 have the two ends respectively fitted around the fitting stage 216 of the wind wheel 215 and the actuating stage 235 of the connecter 232 of the engage wheel 23, and the connect stage 234 of the connecter 232 of the engage wheel 23 is inserted in the connect groove 217 of the wind wheel 21. Thus, though the wind wheel 21 is connected with the engage wheel 23, the both wheels 21 and 23 are not moved together. After that, the wind wheel 21, the engage wheel 23 and the one-way constrict spring 241 all together are placed in the chamber 121 of the main cover 12, with the position stage 214 of the wind wheel 21 protruding out of the rear side of the main cover 12, and with the ratchet 231 of the engage wheel 23 exposed out of the front side of the main cover 12.

Further, the position stage 214 of the wind wheel 21 is inserted in the center hole 113 of the base 11, with the end of the position stage 214 located in the chamber 111. Then the helical spring 40 is placed in the chamber 111, with its inner end fixed tightly with the position stage 214, and with its outer end extending out of the opening 112 as shown in FIG. 5. Now the seal cap 14 is fixed with the base 11, closing up the chamber 111, with the return unit 40 limitedly contained in the chamber 111.

Next, the connective rod 32 of the movement limit unit 30 having its rear end extending through one end (or not the function end of the actuating member 323) of the fitting portion 314 is inserted in the pivot hole 114 of the base 11, and the lower half of the round rod 321 between the position limit member 322 and the actuating member 323 is placed in the second groove 134 of the second retainer 132, with the position limit member 322 located in the contacting member 123 of the main cover 12 with a preset distance from the wall of the contacting member 123. Then the first retainer 131 is fixed tightly on the sidewall of the main cover 12, with the upper half of the round rod 321 between the position limit member 323 and the actuating member 323 located in the first groove 133 of the first retainer 131. Then the connective rod 32 is limited to rotate only in the first groove 133 and the second groove 134.

Figure 11:
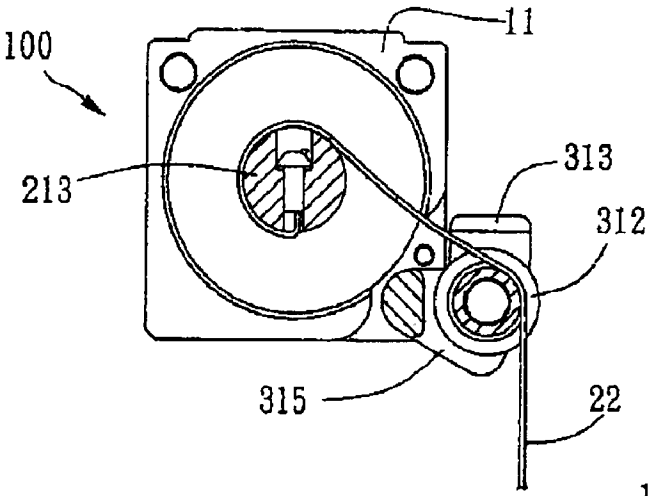
FIG. 11 is a cross-sectional view of the first embodiment of a control device for Venetian blinds in the present invention, showing a rope positioned securely.

Then the intermediate portion of the lever member 331 of the movement limit unit 30 is pivotally connected to the front side of the main cover 12 under the engage wheel 23. Then the coil spring 34 is placed between the projection 122 of the main cover 12 and the position projection 334 of the lever member 331 of the movement limit member 33 so that the resist member 333 of the lever member 331 of the movement limit member 33 may be compressed by the coil spring 34 to move down pivotally, actuating the claw 332 to move up and engage the ratchet 233 of the engage wheel 23, with the resist member 333 located just the actuating member 323. Then the rope 22 has its hanging end at first passing between the force receiving member 312 and the position member 313, extending around the force receiving member 312 and then between the force receiving member 312 and the position member 313 to hang down as shown in FIG. 11.

The use of this control device will be described below.

Figure 2:
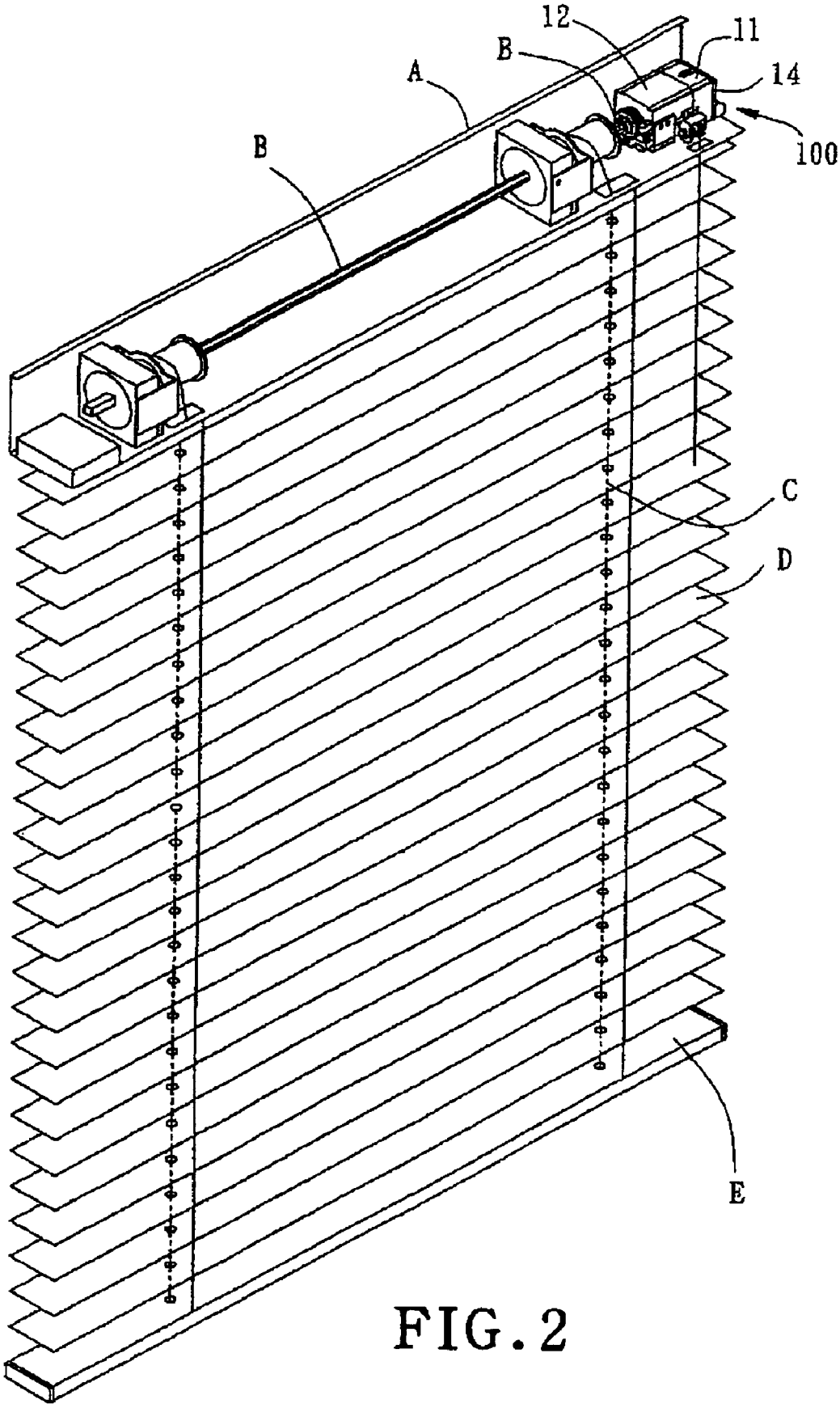
FIG. 2 is a perspective view of a Venetian blind with the first embodiment of a control device being in use in the present invention.
Figure 3:
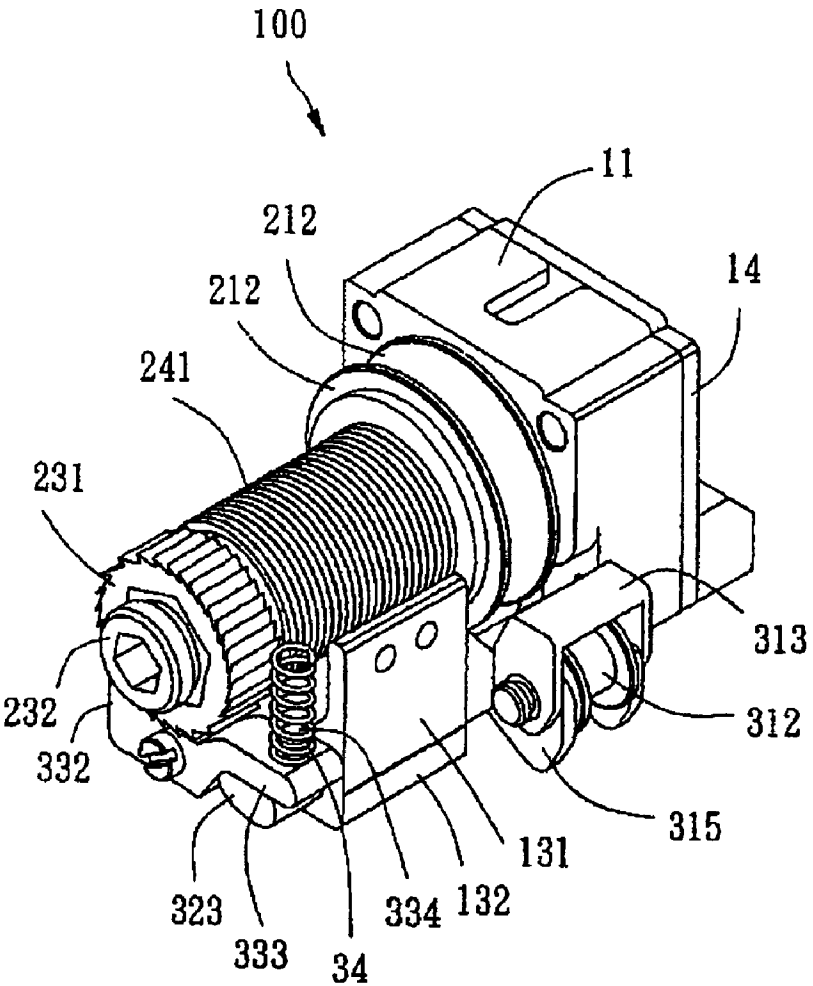
FIG. 3 is a partial perspective view of the first embodiment of a control device for Venetian blinds in the present invention, with a main cover removed.
Figure 4:
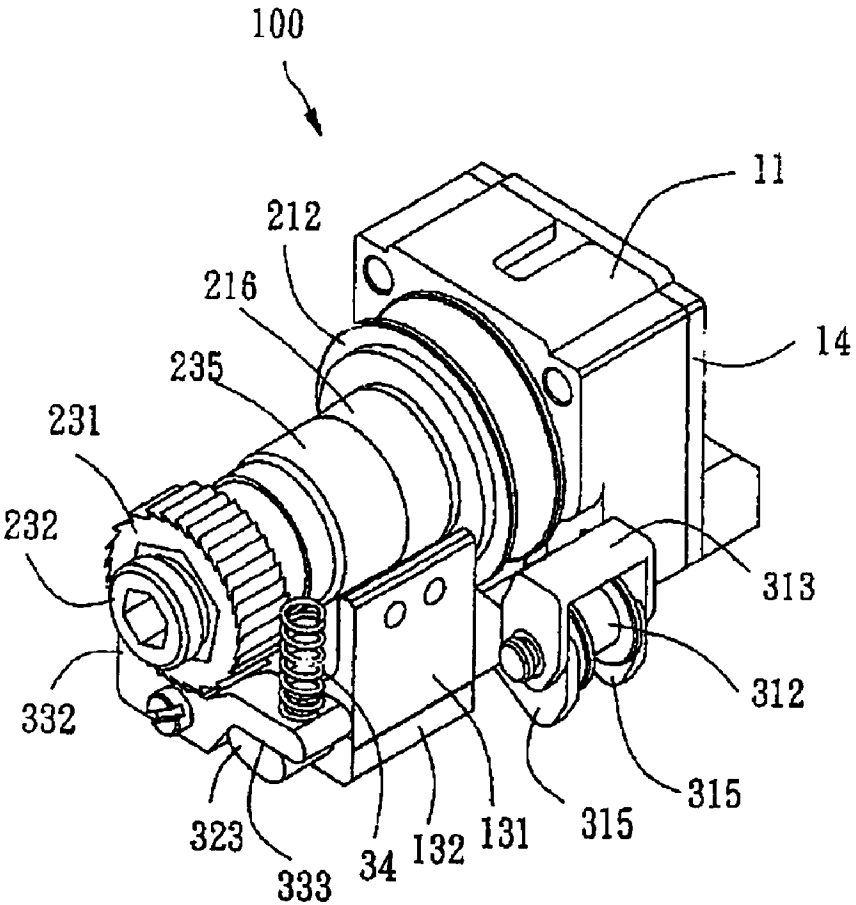
FIG. 4 is a partial perspective view of the first embodiment of a control device for Venetian blinds in the present invention; with the main cover and a one-way constrict spring removed.

To begin with, take a Venetian blind for example as shown in FIG. 2, the control device 100 is placed and fixed firmly on an upper rail (A) of the Venetian blind, and the rope (C) is connected with the lower rail (E) for winding up or down the window covering (D) (plural strips of the Venetian blind shown in the figure, or a cloth blind for a winding blind) by means of a connect rod (B) fitted in the transmitting groove 237 so that the connect rod (B) moves together with the engage wheel 23.

Figure 8:
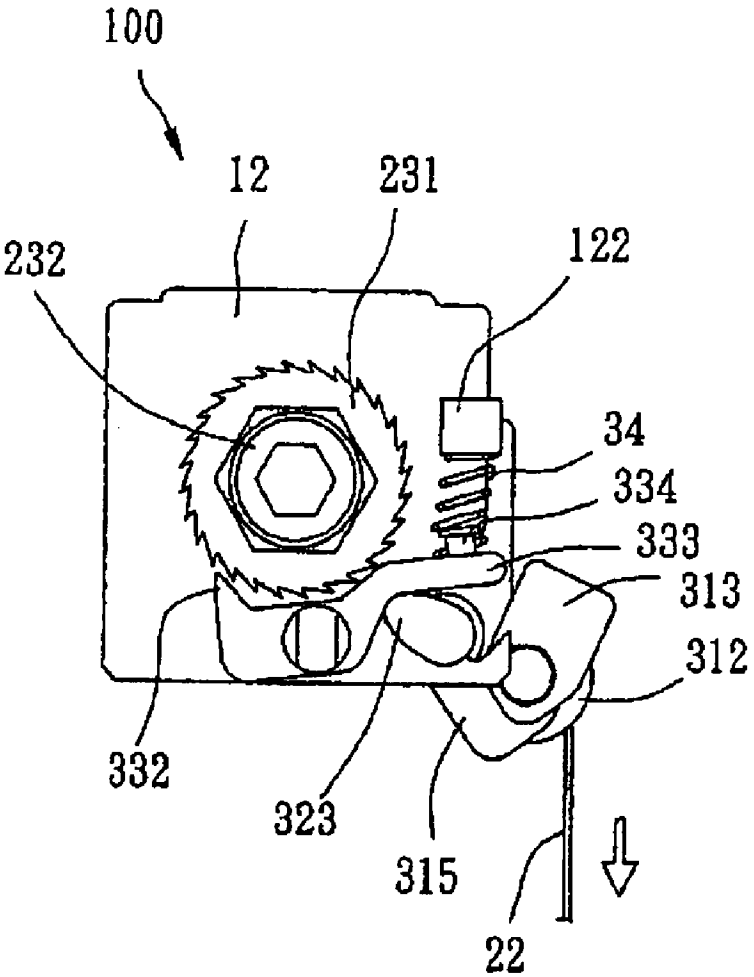
FIG. 8 is a cross-sectional view of the first embodiment of a control device for Venetian blinds in the present invention, showing the engage wheel and the movement limit unit receiving exterior force.
Figure 9:
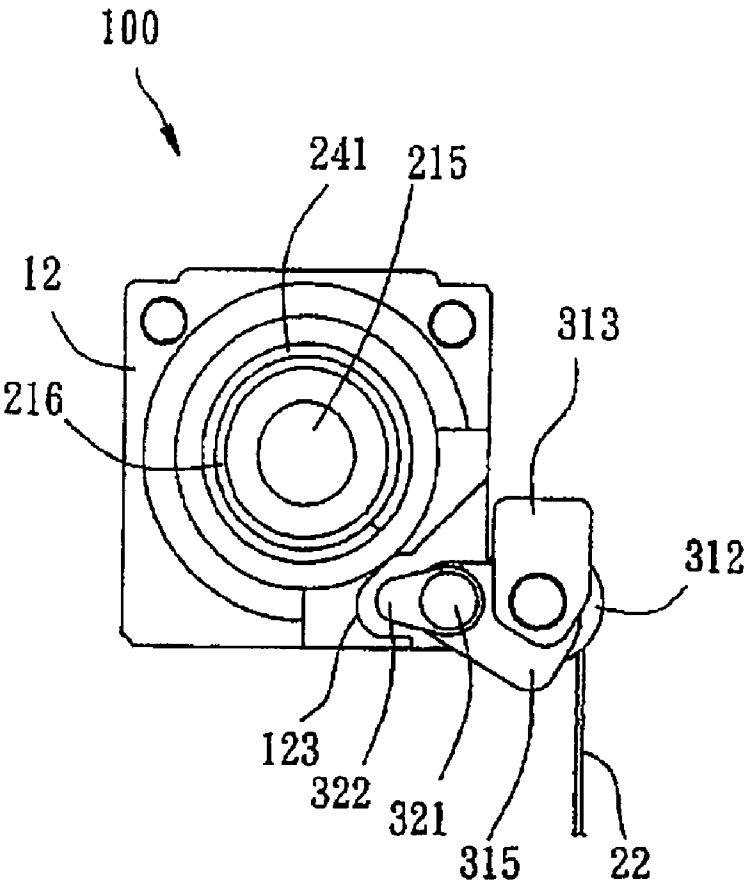
FIG. 9 is a cross-sectional view of the first embodiment for a control device for Venetian blinds in the present invention, showing the movement limit unit and the main cover not receiving exterior force.
Figure 10:
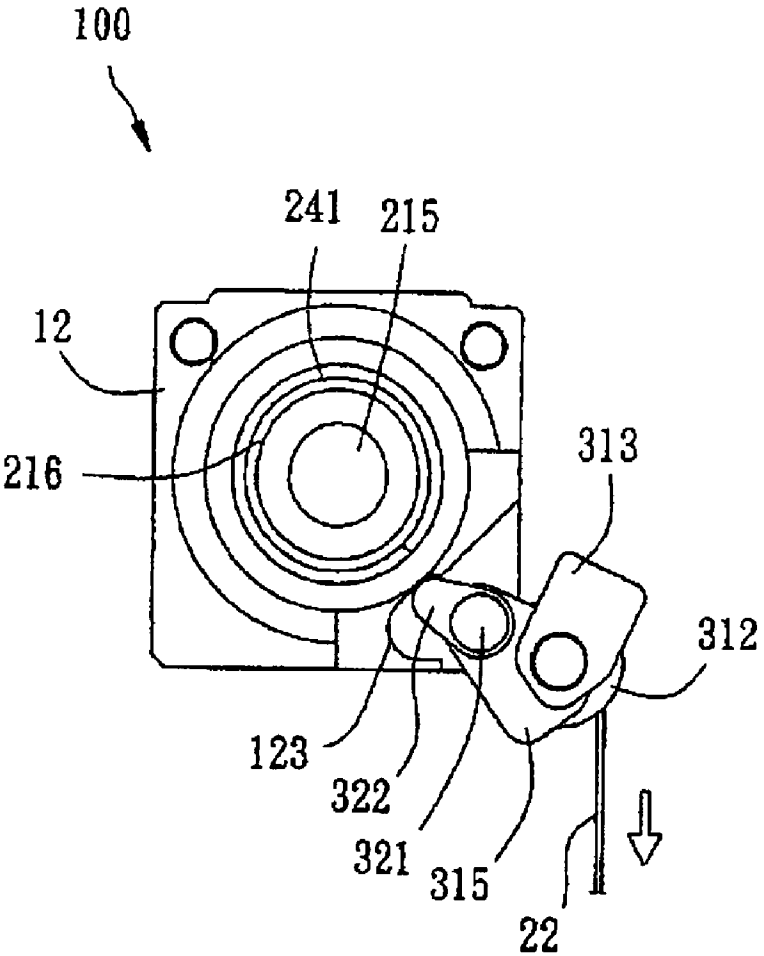
FIG. 10 is a cross-sectional view of a first embodiment for a control device for Venetian blinds in the present invention, showing the movement limit unit and the main cover receiving exterior force.

When the strips are pulled up to a preset height, a user holds the rope 22 and pulls it down. Then the rope 22 receives the manual force, which is then transmitted to the force receiving member 312, which then actuates the bias swing member 311 move down with the connective rod 32 functioning as a pivot. Then the force receiving member 312 rotates the connective rod 32 together in the same direction, letting the position limit member 322 swing up pivotally to push the wall of the contact member 123 of the main cover 12 as shown in FIG. 10, so the connective rod 32 no longer rotates, with the user keeping on pulling down the rope 22. At this time, the actuating member 323 at the same side of the position limit member 322 is also swung up pivotally, and the actuating member 323 pushes up the resist member 333 to swing up pivotally and compress the coil spring 34, with the claw 332 swing down, disengaging from the ratchet 233 as shown in FIG. 8. Meanwhile, the wind wheel 21 rotated by the rope 22 causes the outer surface of the fitting stage 216 to rub with the inner surface of the constrict spring 241 so that the spring 241 may rotate in the same direction, beginning to constrict the fitting stage 216 and the actuating stage 235, letting the wind wheel 21 and the engage wheel 23 rotate together by the constrict function of the spring 241. Thus the connect rod (B) rotating with the engage wheel 23 can rotate to move up the strips of the blind.

Figure 7:
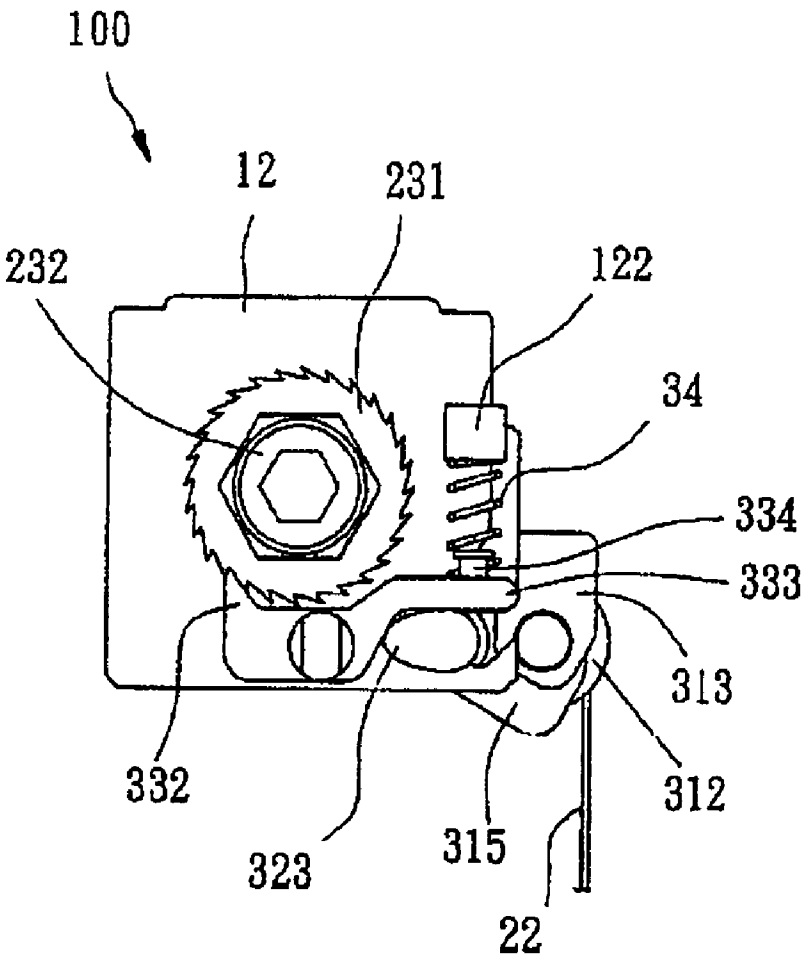
FIG. 7 is a cross-sectional view of the first embodiment of a control device for Venetian blinds in the present invention, showing an engage wheel and a movement limit unit not receiving exterior force.

If a user wants the strips to be positioned at the raised height, the rope 22 is loosened a little, permitting the coil spring 34 push the resist member 333 with the larger resilience than the pulling force of the rope 22 when the spring 34 is recovered after compressed so that the claw 332 may swing up pivotally to engage the ratchet 233 and stop the engage wheel 23 from rotating, as shown in FIG. 7. Therefore, the connect rod (B) can no longer rotate, keeping the strips immovable at that position.

Figure 6:
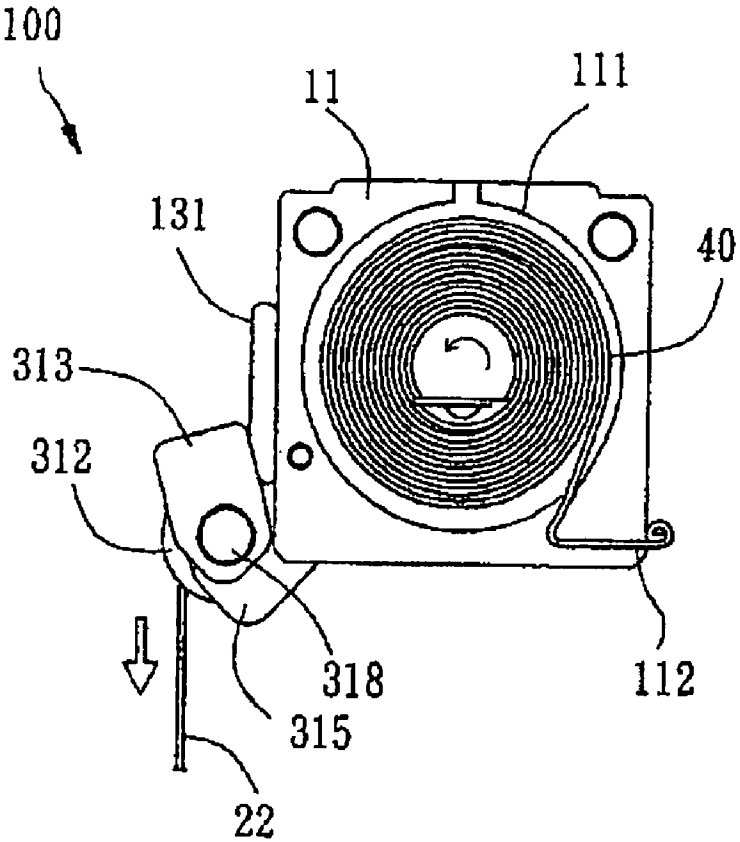
FIG. 6 is a cross-sectional view of the first embodiment of a control device for Venetian blinds in the present invention, showing the return unit receiving exterior force.

Next, when the rope 22 is pulled down, the position stage 214 of the wind wheel 21 rotates to let the return unit 40 constrict owing to tight fixation with the return unit 40 so that the return unit 40 may produce a loosening force, as shown in FIG. 6. Therefore, if a user loosens the rope 22, the return unit 40 may force the wind wheel 21 to rotate because no exterior force (or the manual force of the user) is put on the return unit 40, then the rope 22 is wound around the wind wheel 21, without fear of the rope 22 exposed except the portion hanging down from the wind wheel 21 to cause no danger for a child to have the neck constricted by the rope 22. And it should be noticed that the one-way constrict spring 241 can only constrict in one direction, so when the wind wheel 21 winds the rope 22, the constrict spring 241 cannot constrict, so the engage wheel 23 does not rotate together with the wind wheel 21, and winding the rope 22 on the wing wheel 21 does not give any alteration to the height of the strips of the blind.

If a user wants the strips of the blind to be lowered to a needed height, the rope 22 is pulled a little (a short length) at first with the constrict spring 241 not constricting the engage wheel 23. In otherwords, the wind wheel 21 and the engage wheel 23 are not in the condition of synchronous rotation. So a little pulling down of the rope 22 makes the bias swing member 311 swing bias to actuate the actuating member 323 to move up the resist member 333 for compressing the coil spring 34 to force the claw 332 to disengage from the ratchet 233 of the engage wheel 23, so the weight of the strips can force the engage wheel 23 rotate to permit the strips fall down to the preset height. When the strips stop at the needed height, the rope 22 is released manually to free the coil spring 34, and the claw 332 moves to engage the ratchet 233 of the engage wheel 23 to stop the ratchet 233 from rotating any more, keeping the strips at the needed height.

The control device according to the invention can permit the hanging rope control the strips of a Venetian blind to rise, fall and stop at a needed height, enabling a user easily handle it with convenience, and in addition, the rope 22 is hidden in the wind wheel by the recovering force of the return unit, not exposed so that the rope has no potential danger of such neck constricting for a child as the conventional rope in the Venetian blind has.

Moreover, it is to be noticed that the position member in the control device can prevent the rope from separating from the force receiving member owing to careless handling of a user, and the position limit member of the connective rod can swing for a preset angle by mutual interference so that the coil spring may not be overly compressed by excessive swing angle or the engage wheel and the lever member may not have overly large engage force by excessive swing-down angle to cause damage to the components.

Next, FIGS. 14 to 18 show a second embodiment of a control device for Venetian blinds in the invention, which includes a position unit 50, a rope control unit 60, a movement limit unit 70 and a return unit (not shown), having almost the same structure as the first embodiment, except the different structure to be described below.

The rope control unit 60 consists of a wind wheel 61, a rope 62, an engage wheel 63, and a clutch 64, which are the same as those in the first embodiment, but the engage wheel 63 consists of a friction wheel 631 and a connecter 632. The friction wheel 631 is provided with a hexagonal fitting hole 633 in the center to combine tightly with the fitting stage 636 of the connecter 632. The outer surface of the friction wheel 631 has a high friction coefficient.

The movement limit unit 70 consists of an input member 71, a connective rod 72, a movement limit member 73 and a coil spring 74 of a preset force.

The input member 71 is composed of a bias swing member 711, a force receiving member 712, a position member 713 and a pin 718, as those in the first embodiment. The input member 71 is fixed tightly on the rear end of the connective rod 72, and the connective rod 72 has a round rod 721, a position limit member 722 and an actuating member 723. The input member 71 is fitted on the rear end of the round rod 721, and the position limit member 722 projects sidewise from an intermediate portion of the round rod 721 in the opposite direction of the input member 71. The actuating member 323 protrudes sidewise from an intermediate portion of the round rod 721 in the same side of the round rod 72.

The movement limit member 73 has a lever member 731 and a resist member 732. The lever member 731 has two ends respectively formed with a claw 733 and a resist member 734, a slide groove 735 formed between the claw 733 and the resist member 734 and facing upward, and a sidewise through slide hole 736 in the wall of the lever member 731 and communicating with the slide groove 735. The resist member 732 has a resist block 737 and an actuating block 738 mutually fixed together, and the actuating block 738 is located in the slide groove 735 and pivotally connected in the slide hole 736. The lever member 731 has its intermediate portion pivotally connected with one end of the main cover 52, and the claw 733 is located at one side of the friction wheel 631, with the resist block 737 pivotally connected with the same end of the main cover 52 and a the other side of the friction wheel 631.

Figure 18:
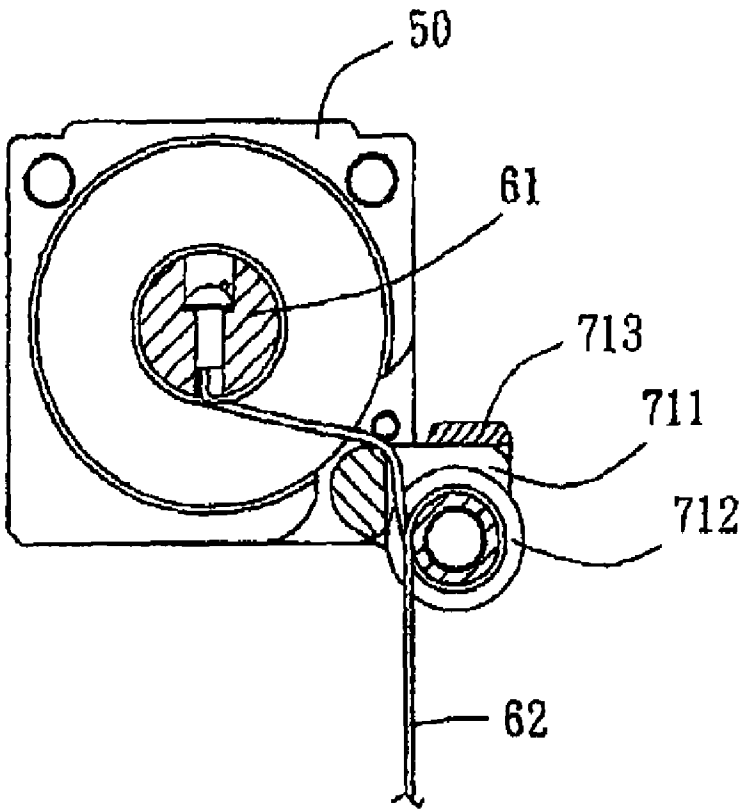
FIG. 18 is a cross-sectional view of the second embodiment of a control device for Venetian blinds in the present invention, showing a rope positioned securely.

The second embodiment and the first embodiment have the same components, and the same combining ways, but the rope 62 is wound not in the same way as the first one. One end of the rope 62 is fixed on the wind wheel 61, and then the other end extends through the inside of the force receiving member 712, and then between the force receiving member 712 and the position member 713 upward to wind around the force receiving member 712 for preset rounds, and finally extends down the inner side of the force receiving member 712, as shown in FIG. 18.

In the second embodiment, the rope 62 controls the wind wheel 61 and the engage wheel 63 to rotate together or not for carrying out control of the window covering of the Venetian blind to adjust and secure the needed height of the window covering, its operational way is in fact a little different from the first embodiment, and is described below.

Figure 16:
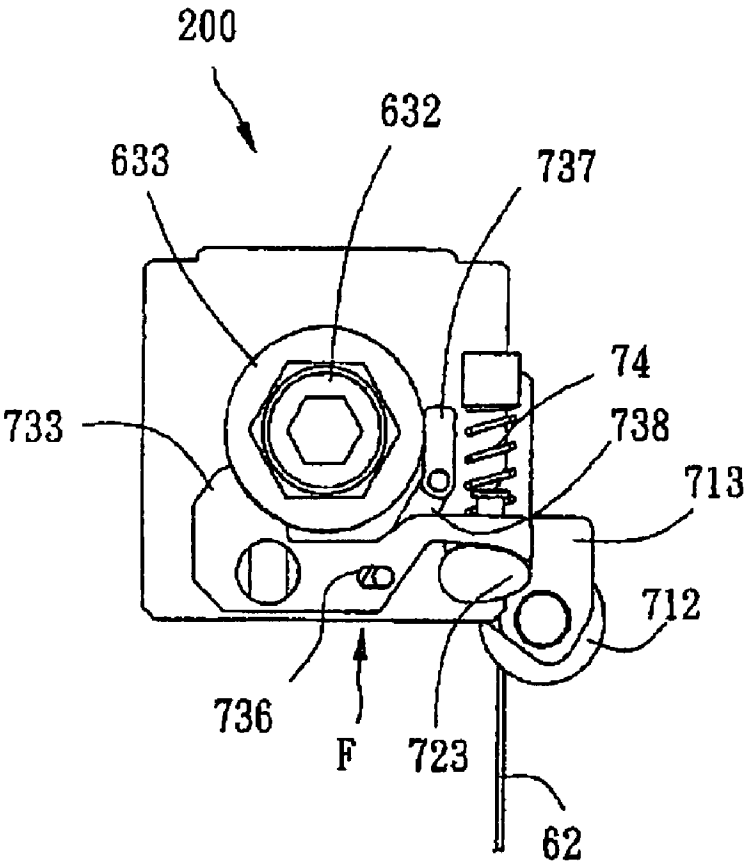
FIG. 16 is a cross-sectional view of the second embodiment for a control device for Venetian blinds in the present invention, showing an engage wheel and a movement limit unit not receiving exterior force.
Figure 17:
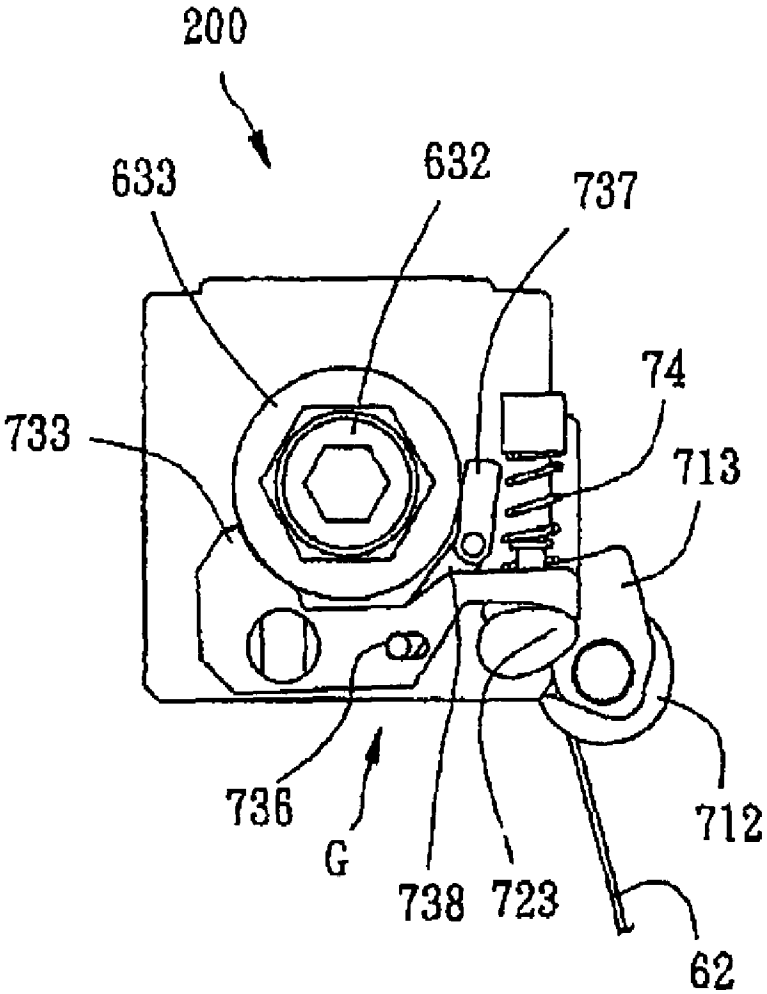
FIG. 17 is a cross-sectional view of the second embodiment of a control device for Venetian blinds in the present invention, showing the engage wheel and the movement limit unit receiving exterior force.

At first, when the rope 62 does not receive exterior force as shown in FIG. 16, the coil spring 74 compresses the resist member 734 of the engage member 731, with the claw 733 swung up pivotally to contact closely the outer surface of the friction wheel 631. When the lever member 731 is swung pivotally, the actuating block 738 is moved, the pivot point of the actuating block 738 and the engage member 731 will be moved to the location marked F in FIG. 16, by the swinging angle of the slide hole 736 and the engage member 731. When the actuating block 738 is located at the point F, the resist block 737 contacts the outer surface of the friction wheel 631, and the claw 733 and the resist block 737 of the resist member 732 hampers the friction wheel 631 immovable at a secured position.

If the window covering of the blind is to be collapsed, a user at first pulls up slantingly and keep on pulling, letting the rope 62 move up slantingly, with the force receiving member 712 synchronously swing up, and with the connective rod 72 rotated synchronously by the force receiving member 712. Then the actuating member 723 begins to push up the resist member 734 of the lever member 731 so that the coil spring 74 is compressed, forcing the claw 733 swing down to separate from the friction wheel 631, not contacting its outer surface. Meanwhile, the pivotal location of the lever member 731 may shift to a second position marked by the letter G in FIG. 17, with the actuating block 738 guided by the slide hole 736, so the resist block 737 separates from the friction wheel 631 owing to the shifting of the actuating block 738. If the rope 62 is kept on pulled, the wind wheel 61 may rotate together with the constrict spring 641, which then rotates the engage wheel 63, with the connect rod of the blind firmly connected with the engage wheel 63 rotating to raise up the strips of the blind to a needed height.

Next, if the window covering raised up to the needed height is to be secured stably at that position, the rope 62 is loosened a bit, letting the force receiving member 712 recover its resiliency larger than the exterior force against the coil spring 74. Then the coil spring 74 can compress the resist member 734, with the claw 733 swing up to contact closely the outer surface of the friction wheel 631, and the actuating block 739 shifts to the first location (F), permitting the resist block 737 contact the outer surface of the friction wheel 631, with the engage wheel 63 is positioned at its location, keeping tightly the window covering at the preset height.

If the window covering is to be lowered, at first, the rope 62 is pulled a little slantingly up, forcing the force receiving member 712 to swing up a bit, with the actuating member 723 push up the resist member 734, and with the claw 733 swing down to separate from the outer surface of the friction wheel 631, and with the resist member 737 separate from the outer surface of the friction wheel 631, then the weight of the window covering rotates the engage wheel 63 to let the window covering fall down to the needed height. As the constrict spring 641 is designed to have a special rotating way, it cannot constrict even if the window covering rotates the engage wheel 63, with the wind wheel 61 getting no impact.

Moreover, as the return unit gives rise to recovering constrict force in case of the rope 62 kept on pulling, the return unit may produce reverse rotary force against the wind wheel 61, so the rope 62 may be wound on the wind wheel 61, hiding the rope 62 in the wind wheel 61. In addition, the wind wheel 61 is impossible to constrict the constrict spring 641 during winding the rope 62 thereon, so it gives no impact to the engage wheel 63, nor to the window covering.

Figure 19:
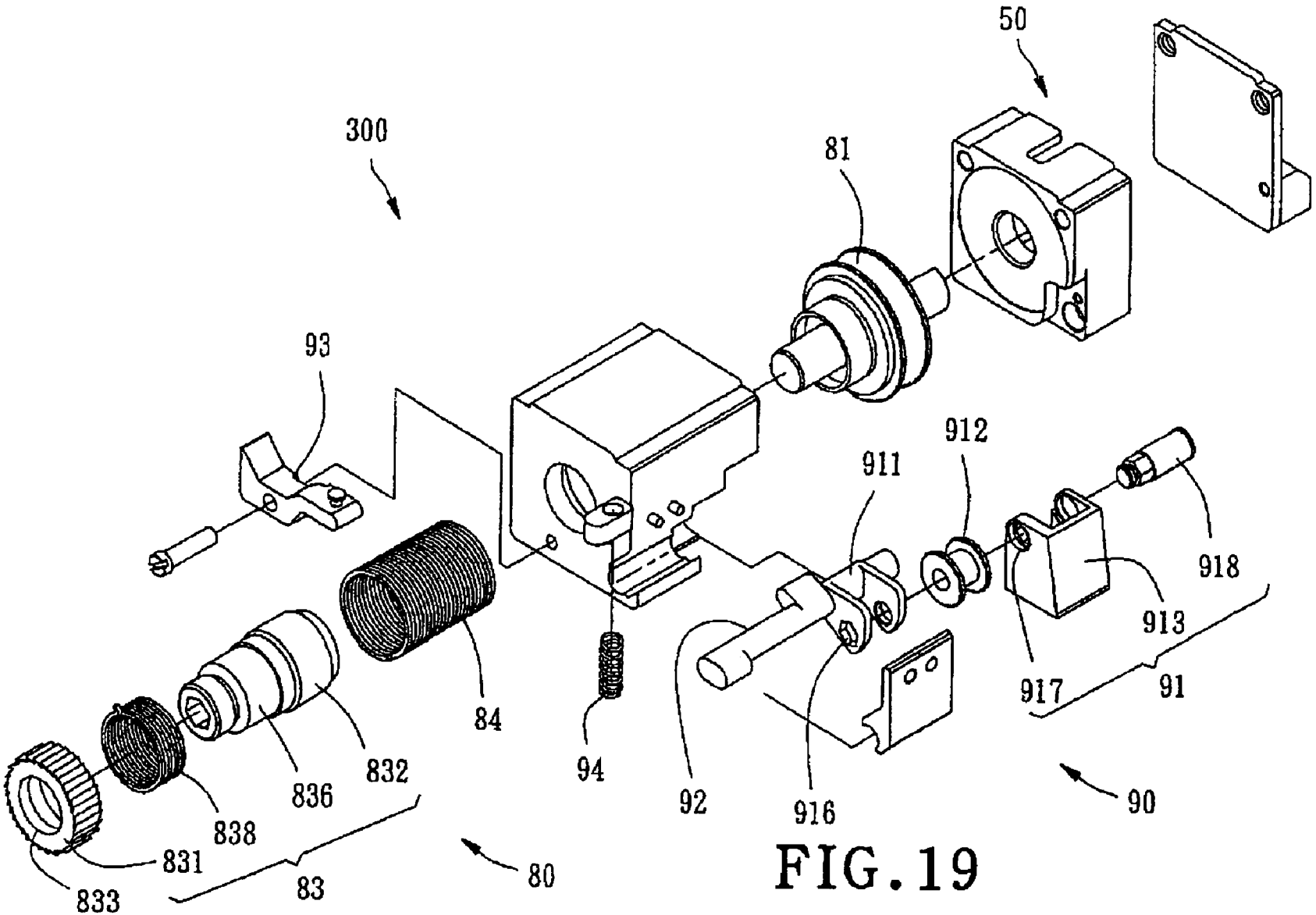
FIG. 19 is an exploded perspective view of a third embodiment of a control device for Venetian blinds in the present invention.
Figure 20:
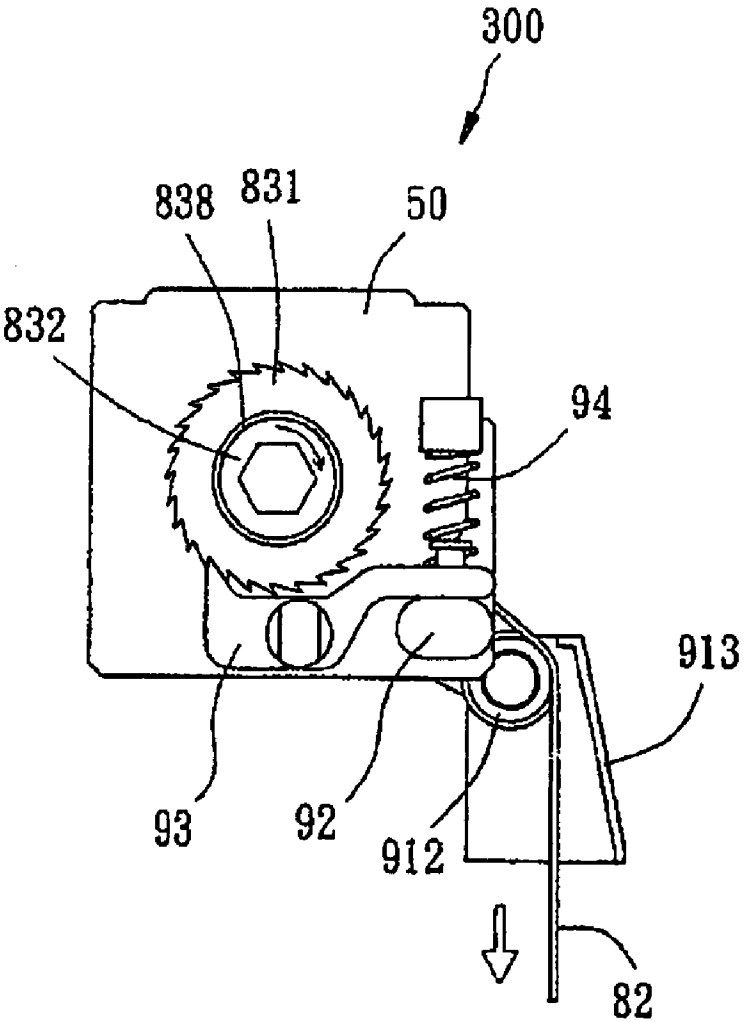
FIG. 20 is a cross-sectional view of the third embodiment of a control device for Venetian blinds in the present invention, showing an engage wheel and a movement limit unit not receiving exterior force; and, FIG. 21 is a cross-sectional view of the third embodiment of a control device for Venetian blinds in the present invention, showing the engage wheel and the movement limit unit receiving exterior force.
Figure 21:
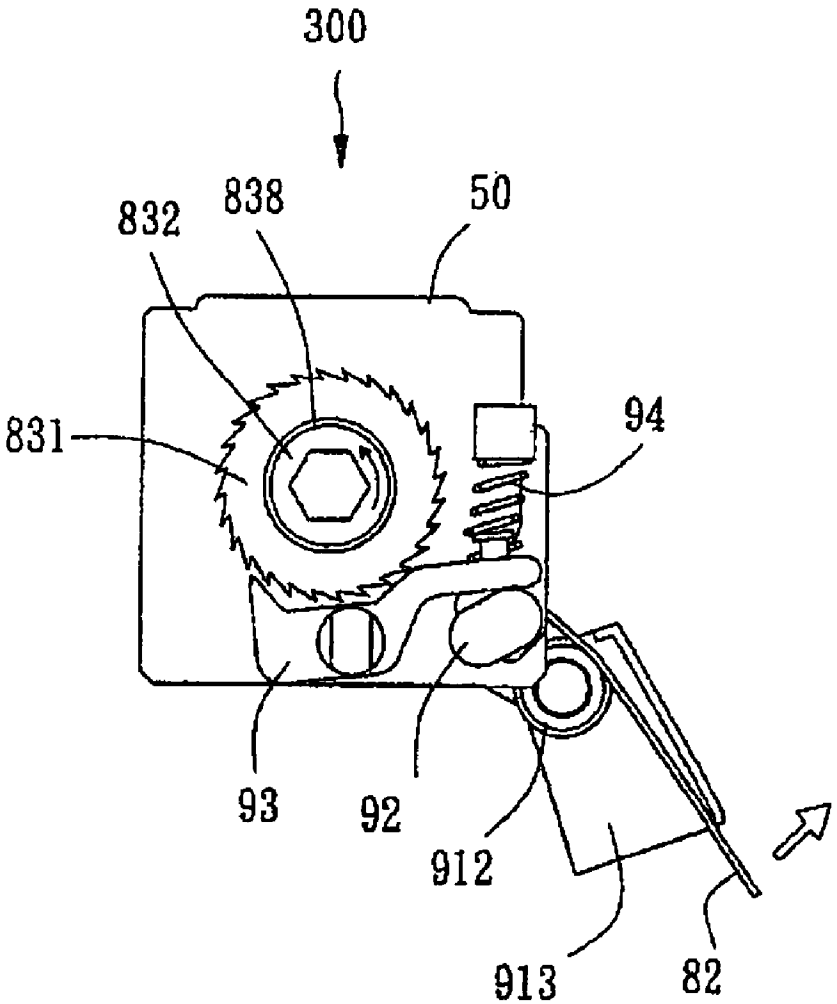

Next, FIGS. 19, 20 and 21 show a third embodiment of a control device 300 for Venetian blinds, which includes a position unit 50, a rope control unit 80, a movement limit unit 90 and a return unit (not shown). The rope control unit 80 consists of a wind wheel 81, a rope 82, an engage wheel 83 and a clutch 84, and the movement limit unit 90 is composed of an input member 91, a connective rod 92, a movement limit member 93 and a coil spring 94 of a preset force. The different structure of the third embodiment from the first and the second one is to be described below.

The input member 91 consists of a bias swing member 911, a force receiving member 912, a position member 913 and a pin 916.

The bias swing member 911 has two pivot holes 916, and at least one of the pivot holes 916 is non-circular, and the position member 913 has two insert holes 917, and at least one of the insert holes 917 is non-circular, with the pin 918 having one end of a non-circular shape inserted in the insert hole 917 and the pivot hole 916 and also in the center hole of the force receiving member 912. So the position member 913 and the bias swing member 911 rotate together owing to the non-circular pivot hole 916 and the non-circular insert hole 917 connected by the pin 918. Then the rope 82 only extends between the force receiving member 912 and the position member 913, not needing to wind around the force receiving member 912. So if the movement limit member 93 is to be separated from the engage wheel 83, the rope 82 is pulled up slantingly, and directly contacts and swings up the position member 913, which then swings up synchronously the bias swing member 911, with the movement limit member 93 separating from the engage wheel 83 as shown in FIG. 21. Thus the window covering of a blind may be lowered, and the return unit winds the rope 82 without frictional force owing to the rope not winding around the force receiving member 912, enabling the winding action of the rope 82 smoothly operated.

In addition, the rope control unit 80 not only has a one-way ratchet 831, and a connecter 832 but also a one-way coil spring 838 fitting around the fitting stage 836 of the connecter 832 and having one end fixed with the fitting stage 836 so that the ratchet 831 has its center hole 833 fitting around the fitting stage 836, with the one-way coil spring 838 is located between the fitting stage 836 and the center hole 833 of the ratchet 831,with the other end of the coil spring 838 fixed with the ratchet 831. Then the ratchet 831 and the connecter 832 only rotate together in the same direction. So when the connecter 832 rotates by the wind wheel 81 rotated by the rope 82, the ratchet 831 and the connect member 832 do not rotate together. When the connecter 832 rotates in the direction of the wind wheel 81 winding the rope 82, the ratchet 831 and the connecter 832 rotate together in the same direction. Therefore, if the window covering of the blind is to be pulled up for collapsing, the rope 82 is directly pulled down as shown in FIG. 20. Although the movement limit member 93 and the ratchet 831 are in the engaged condition, the wind wheel 81 and the clutch 84 still can rotate the connecter 832, because the one-way spring 838 rotates in a different direction from that of the ratchet 831 and the connecter 832. So the window covering is raised up.

While the preferred embodiments of the invention have been described above, it will be recognized and understood that various modifications may be made therein and the appended claims are intended to cover all such modifications that may fall within the spirit and scope of the invention.

What is claimed is:

1. A control device for Venetian blinds to control the hiding condition of a window covering of a Venetian blind, said control device comprising:

a positioning unit fixed on an upper rail of said Venetian blind;

a rope control unit consisting of a wind wheel, a rope, an engage wheel and a clutch, said wind wheel rotatably connected to said position unit, said rope having one end fixed tightly with said wind wheel and the other end hanging down for a user to hold for handling, said wind wheel rotated by said rope, said engage wheel fitting with said wind wheel and fixed tightly with said window covering, said clutch connected with said wind wheel and said engage wheel, said wind wheel and said engage wheel rotating in the same direction in case said wind wheel rotates said clutch in a first direction, said wind wheel and said engage wheel rotating in different direction in case said wind wheel rotates said clutch in a second direction; and a movement control unit connected pivotally to said positioning unit, having a lever member beside said engage wheel and moved by said rope to engage with or disengage from said engage wheel for controlling an upwardly and downwardly movement of said window covering, wherein said engage wheel includes a ratchet and a connecter, said ratchet having many inclined teeth in the same direction and a fitting hole formed in the center; said connecter has a connect stage, an actuating stage and fitting stage, said connect stage connected to said wind wheel by fitting, said actuating stage fitting around by said clutch, said fitting stage fitting in said fitting hole to let said ratchet rotating with said connecter, wherein said engage wheel has a one-way coil spring, which has one end fixed with said connecter and the other end fixed on said ratchet, so said connecter may rotate in the same direction as said ratchet does, and also in the reverse direction from said ratchet.

2. The control device for Venetian blinds as claimed in claim 1, wherein said control device further includes a return unit fixed firmly with said wind wheel, and when said rope is wound around said wind wheel, said return unit gives rise to a rewinding force to wind said rope back around said wind wheel in case of a manual force of a user ends.

3. The control device for Venetian blinds as claimed in claim 1, wherein said position unit includes a base with a chamber formed in its one end portion, said base further has a hole formed in the other end portion and communicating with said chamber, said wind wheel has one end inserted in said chamber through said hole; said return unit is a helical spring, which is placed in said chamber, having one end fixed on said wind wheel and the other end fixed on said base, so said helical spring can produce rewinding force by means of rotation of said wind wheel.

4. The control device for Venetian blinds as claimed in claim 3, wherein said position unit further includes a seal cap, which seals an opening end of said chamber of said base for preventing said return unit from falling out of said base.

5. The control device for Venetian blinds as claimed in claim 3, wherein said base has a pivot hole formed in one corner of the side with said hole, said pivot hole usable for connecting pivotally a movement limit unit to said base.

6. The control device for Venetian blinds as claimed in claim 1, further comprising a main cover, said main cover has a chamber in its interior for containing said wind wheel, said clutch and said engage wheel therein, said main cover having a projection on a front side; a movement limit member has a lever member, said lever member having its intermediate portion pivotally connected to the front side of said main cover and located under said projection, said lever member having two ends respectively formed with a claw and a resist member; said movement control unit further has a coil spring of a preset force, said coil spring is located between said projection and said resist member, such that said coil spring elastically pushing said resist member and said claw swinging up to engage with a ratchet of said engage wheel, or an interacting movement of said rope forcing said resist member to compress said coil spring to force said claw to disengage from said ratchet.

7. The control device for Venetian blinds as claimed in claim 1, wherein said wind wheel is composed of a round rod and two flanges formed spaced apart on an intermediate portion of said round rod, said two flanges separated from each other with a preset gap, said round rod having a winding stage on said preset gap between said two flanges, a position stage between said front flange and the front end pivotally connected to said position unit, and a connect stage between said rear flange and the rear end, said round rod further having a fitting stage on said connect stage to form a connect groove between said fitting stage and said connect stage; said rope has one end fixed on said winding stage; said engage wheel has a connect stage and an actuating stage, said connect stage fitting in said connect groove of said wind wheel; said clutch fits between said fitting stage of said wind wheel and said actuating stage of said engage wheel.

8. The control device for Venetian blinds as claimed in claim 1, wherein said engage wheel is composed of a friction wheel and a connecter, said friction wheel has an outer surface with high friction coefficient and a fitting hole in the center; said connecter has a connect stage, an actuating stage and a fitting stage, said connect stage fitting around said wind wheel, said actuating stage fitting around said clutch, said fitting stage fitting in said fitting hole to let said friction wheel rotate together.

9. The control device for Venetian blinds as claimed in claim 8, wherein said engage wheel further has a one-way coil spring, which has one end fixed with said connecter and the other end fixed on said friction wheel, so the connecter may rotate in the same direction as said friction wheel, and also in the reverse direction as said friction wheel.

10. The control device for Venetian blinds as claimed in claim 1, wherein said clutch is a one-way constrict spring, which constricts its inner diameter in case of rotation in one direction, and releases its inner diameter in case of rotation in the other direction.

11. The control device for Venetian blinds as claimed in claim 1, wherein said movement control unit includes a lever member, which is pivotally connected to said position unit under said engage wheel, having one end formed with a claw and the other end formed with a resist member, said resist member swung by movement of said rope so that said claw may engage with or disengage from a ratchet of said engage wheel.

12. The control device for Venetian blinds as claimed in claim 11, wherein said movement control unit further includes a force resist member composed of a resist block and a function block; between said claw of said engage member and said resist member is provided with a slide groove facing upward, one side of said slide groove is provided with a slide hole communicating with said slide groove, said slide hole is elongate; said function block is located in said slide groove and pivotally connected with said slide hole, said resist block is pivotally connected with said position unit, said function block may slide in said slide hole to let said resist block contact or separate from said ratchet when said resist member swings.

13. A control device for Venetian blinds to control the hiding condition of a window covering of a Venetian blind, said control device comprising:

a positioning unit fixed on an upper rail of said Venetian blind;

a rope control unit consisting of a wind wheel, a rope, an engage wheel and a clutch, said wind wheel rotatably connected to said position unit, said rope having one end fixed tightly with said wind wheel and the other end hanging down for a user to hold for handling, said wind wheel rotated by said rope, said engage wheel fitting with said wind wheel and fixed tightly with said window covering, said clutch connected with said wind wheel and said engage wheel, said wind wheel and said engage wheel rotating in the same direction in case said wind wheel rotates said clutch in a first direction, said wind wheel and said engage wheel rotating in different direction in case said wind wheel rotates said clutch in a second direction; and a movement control unit connected pivotally to said positioning unit, having a lever member beside said engage wheel and moved by said rope to engage with or disengage from said engage wheel for controlling an upwardly and downwardly movement of said window covering, wherein said said movement control unit includes an input member, a connective rod, and a coil spring of a preset force, said input member fixed to one end of said connective rod, said connective rod connected pivotally in said position unit, said connective rod swinging via said rope and having the other end formed as an actuating member, said actuating member pushing said lever member when said force receiving member swinging via said rope so that said lever member disengaged from a ratchet of said engage wheel, said coil spring pushing elastically said lever member to force said lever member engaging said ratchet when said rope does not receive force.

14. The control device for Venetian blinds as claimed in claim 13, where in said force receiving member has a bias swing member and a force receiving member, said bias swing member consisting of a hollow fitting portion and two parallel wings projecting sidewise from said fitting portion, said two parallel wings respectively having a pivot hole aligned to each other, said bias swing member fitting around one end of said connective rod and located at an outside of said connective rod, said force receiving member pivotally connected between said two wings for said rope to wind around thereon so that said rope may rotate said bias swing member and let said connective rod rotate.

15. The control device for Venetian blinds as claimed in claim 13, wherein said position unit further has a contact member; said connective rod has a position limit member formed in its intermediate portion, said force receiving member contacting said contact member to be limited together with said connective rod in their rotating angle when said force receiving member is swung for a present angle by the function of said rope.

16. The control device for Venetian blinds as claimed in claim 13, wherein said position unit further has a retain member, said retain member having a first retainer and a second retainer, said first retainer formed with a first groove, said second retainer formed with a second groove; said connective rod is placed between said first groove and said second groove for restricting said connective rod rotate only at the original spot.

17. A control method for changing positions of a window covering of a Venetian blind, which comprises the steps of:

(1) controlling rising up of said window covering, pulling a rope exposed out of said blind to wind a wind wheel in a first direction, said wind wheel rotating a clutch and a ratchet synchronously in case of said wind wheel rotating in the first direction, said ratchet rotating a connective rod fixed with said window covering of said blind for winding up said window covering;

(2) securing stably said window covering at a position, loosening said rope exposed out of said blind, a movement control member contacting with said ratchet for limiting said ratchet in its rotation and subsequently hampering said connective rod fixed with said window covering from rotating so as to secure said window covering stably at that position; and (3) controlling lowering down of said window covering, pulling a bit said rope exposed out of said blind to let said movement control member disengage from said ratchet, said window covering then rotating by its own weight said connective rod and said ratchet in a second direction to disable said ratchet rotate said clutch and said wind wheel to let said window covering move down, wherein said said movement control unit is composed of a force receiving member, a connective rod, a movement limit member and a coil spring of a preset force, said force receiving member fixed at one end of said connective rod and swung by said rope, said connective rod having the other end formed with an actuating member, said movement limit member having a lever member, said lever member having an end formed with a claw and the other end formed with a resist member, said resist member connected pivotally under said actuating member, said coil spring located on said resist member to give a preset pressure so that said resist member may be pressed down and raise up said claw pivotally to engage with said ratchet and subsequently secure said window covering at that position.

18. The control method for changing the hiding dimensions of a window covering of a Venetian blind as claimed in claim 17, wherein said clutch is a one-way constrict spring fitted on said wind wheel and said ratchet, having two ends respectively fixed with said wind wheel and said ratchet, enabling said wind wheel rotate said constrict spring to constrict its inner diameter for rotating said ratchet in the same direction in case of said wind wheel rotating in the first direction; said ratchet loosening said constrict spring to disable said ratchet rotate said wind wheel in case of said ratchet rotating in the second direction.

19. The control method for changing the hiding dimensions of a window covering of a Venetian blind as claimed in claim 17, wherein during the lowering step of said window covering, pulling a bit said rope can force said force receiving member swing and actuate said connective rod swing to push up said resist member, so said claw swings down and disengages from said ratchet, and the weight of said window covering forces said connect rod and said ratchet rotate in the second direction to let said window covering move down.

20. The control method for changing the hiding dimensions of a window covering of a Venetian blind as claimed in claim 17, wherein during the step of raising up said window covering, keeping on pulling said rope can swing said force receiving member and said connect rod to let said actuating member push up said resist member, so said claw may swing down to disengage from said ratchet so as to let said wind wheel rotate in the first direction, and said clutch may rotate in the same direction to raise up said window covering.

21. The control method for changing the hiding dimensions of a window covering of a Venetian blind as claimed in claim 17, wherein said engage wheel includes a ratchet and a connecter, said ratchet fixed with said connecter, said connecter fixed with one end of said clutch, and said movement limit unit engages or disengages from said ratchet by said rope pulled or not.

22. The control method for changing the hiding dimensions of a window covering of a Venetian blind as claimed in claim 21, wherein said ratchet further has a one-way coil spring, which has one end fixed on said ratchet and the other end fixed on said connecter, so keeping on pulling said rope does not swing said movement limit unit, which is kept in the engaged condition with said ratchet, and said window covering is raised up by said wind wheel rotating said connecter in the first direction.

* * * * *